US011566517B2

(12) United States Patent
Li et al.

(10) Patent No.: US 11,566,517 B2
(45) Date of Patent: Jan. 31, 2023

(54) QUANTIFYING CEMENT BONDING QUALITY OF CASED-HOLE WELLS USING A QUALITY INDEX BASED ON FREQUENCY SPECTRA

(71) Applicants: Baoyan Li, Tomball, TX (US); Elan Yogeswaren, Houston, TX (US); Marc Ramirez, Missouri City, TX (US)

(72) Inventors: Baoyan Li, Tomball, TX (US); Elan Yogeswaren, Houston, TX (US); Marc Ramirez, Missouri City, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/398,287

(22) Filed: Aug. 10, 2021

(65) Prior Publication Data

US 2022/0049600 A1 Feb. 17, 2022

Related U.S. Application Data

(60) Provisional application No. 63/064,999, filed on Aug. 13, 2020.

(51) Int. Cl.

| | |
|---|---|
| ***E21B 47/005*** | (2012.01) |
| ***E21B 47/16*** | (2006.01) |
| ***E21B 43/10*** | (2006.01) |

(52) U.S. Cl.

CPC ..... *E21B 47/16* (2013.01); *E21B 43/10* (2013.01); *E21B 47/005* (2020.05)

(58) Field of Classification Search

None

See application file for complete search history.

(56) References Cited

U.S. PATENT DOCUMENTS 5,907,131 A * 5/1999 Tello ..... E21B 47/005 181/102
10,677,040 B2 * 6/2020 Hu ..... E21B 47/005

(Continued)

FOREIGN PATENT DOCUMENTS

| | | |
|---|---|---|
| EP | 1795919 A2 | 6/2007 |
| WO | 2016187242 A1 | 11/2016 |

OTHER PUBLICATIONS

International Search Report and Written Opinion for PCT/US2021/045529; Korean Intellectual Property Office; dated Nov. 21, 2021; 8 pages.

(Continued)

*Primary Examiner* — Curtis A Kuntz
*Assistant Examiner* — Jerold B Murphy
(74) *Attorney, Agent, or Firm* — Cantor Colburn LLP

(57) ABSTRACT

A method for characterizing a bond between a first tubular disposed in a borehole and a structure outside of the tubular, the method includes transmitting a signal into and through the first tubular using a signal transmitter conveyed through the borehole and detecting a return signal using a return signal receiver conveyed through the borehole to provide return signal information in a time domain. The method also includes transforming the return signal information in the time domain to return signal information in a frequency domain using a transform and determining a difference between the return signal information in the frequency domain and reference frequency domain return signal information. The method further includes characterizing the bond of the first tubular to the structure outside of the first tubular using the difference to provide a characterization of the bond.

21 Claims, 11 Drawing Sheets

(56) References Cited

U.S. PATENT DOCUMENTS

| | | | | |
|---|---|---|---|---|
| 2015/0369939 | A1* | 12/2015 | Pistre | E21B 47/005 367/35 |
| 2017/0089846 | A1 | 3/2017 | Guo et al. | |
| 2017/0123105 | A1* | 5/2017 | Quintero | G01V 11/002 |
| 2017/0204719 | A1* | 7/2017 | Babakhani | G01V 3/30 |
| 2018/0023383 | A1* | 1/2018 | Hori | E21B 47/005 166/253.1 |
| 2018/0128094 | A1* | 5/2018 | Merciu | E21B 47/005 |
| 2018/0128930 | A1* | 5/2018 | Zhao | G01V 1/50 |
| 2019/0033484 | A1 | 1/2019 | Stoller et al. | |
| 2020/0018150 | A1 | 1/2020 | Quintero | |
| 2020/0033494 | A1* | 1/2020 | Patterson | E21B 47/005 |

OTHER PUBLICATIONS

Zhang et al., "Multi-String Isolation Logging—A Cost Effective Solution for P&A"; Society of Petroleum Engineers Paper No. 195607-MS; May 14, 2019; 17 pages.

Zhao et al., "Acoustic method of through-tubing cement bond evaluation based on Mie resonances"; Society of Exploration Geophysics; 2018; 4 pages.

* cited by examiner

QUANTIFYING CEMENT BONDING QUALITY OF CASED-HOLE WELLS USING A QUALITY INDEX BASED ON FREQUENCY SPECTRA

This application is a non-provisional of U.S. Application Ser. No. 63/064,999 filed Aug. 13, 2020, the disclosure of which is incorporated by reference herein in its entirety.

BACKGROUND

Boreholes or wellbores drilled into geologic subsurface formations for the extraction of hydrocarbons are typically lined with a casing or tubing. The casing for example prevents the formation wall from caving into the borehole and isolates different formation zones to prevent the flow or crossflow of formation fluids. In order to prevent formation fluid communication between different layers in the subsurface formations, the casing is cemented to the wellbore wall.

When dormant wells are going to be reused or wells are going to be abandoned, it is necessary to verify the integrity of the cement bonding in order to ensure that formation fluid does not leak between the layers or to the surface. Hence, it would be well received in the hydrocarbon production industry if methods and apparatus were developed to inspect the cement bonding casings to wellbores.

BRIEF SUMMARY

Disclosed is a method for characterizing a bond between a first tubular disposed in a borehole and a structure outside of the tubular. The method includes: transmitting a signal into and through the first tubular using a signal transmitter conveyed through the borehole; detecting a return signal using a return signal receiver conveyed through the borehole to provide return signal information in a time domain; transforming the return signal information in the time domain to return signal information in a frequency domain using a transform; determining a difference between the return signal information in the frequency domain and reference frequency domain return signal information; and characterizing the bond of the first tubular to the structure outside of the first tubular using the difference to provide a characterization of the bond.

Also disclosed is an apparatus for characterizing a bond of a first tubular disposed in a borehole to a structure outside of the tubular. The apparatus includes: a carrier configured to be conveyed through the borehole; a signal transmitter disposed on the carrier and configured to transmit a signal into and through the first tubular; and a return signal detector disposed on the carrier and configured to detect a return signal to provide return signal information in a time domain. The apparatus also includes a processor configured to: (i) transform the return signal in the time domain to return signal information in a frequency domain using a transform; (ii) determine a difference between the return signal information in the frequency domain and reference frequency domain return signal information; and (iii) characterize the bond of the first tubular to the structure outside of the first tubular using the difference.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method presented herein by way of exemplification and not limitation with reference to the figures.

Disclosed are methods and apparatuses for characterizing a bond of a first tubular disposed in a borehole to a structure outside of the tubular. In one or more embodiments, the first tubular is a casing cemented to a borehole wall. In one or more other embodiments, the first tubular is a plurality of nested tubulars with one inside another and with the outermost tubular cemented to a borehole wall. The term "characterizing" may include detecting one or more defects in a bond or in multiple bonds for the case of multiple tubulars and determining a location of the one or more defects.

A signal transmitter is conveyed through an innermost tubular disposed in a borehole and transmits a signal into and through the tubular. The signal can have different types of energy and characteristics as discussed further below. In response to the transmitted signal, a return signal is received by a signal receiver to provide return signal information in a time domain. A processor then transforms the time domain return signal information into a frequency domain using a transform. By determining a difference or comparing between the frequency domain return signal information and a frequency domain reference return signal representative of a satisfactory bond or certain types of defects, a defect in a bond can be identified along its corresponding location.

The return signal in the time domain is transformed into a frequency domain because one or more bonding defects will readily alter the spectral characteristics of the return signal in the frequency domain and, thus, provide for identifying those bonding defects and their locations when a comparison is made to the frequency domain reference return signal.

Figure 1:
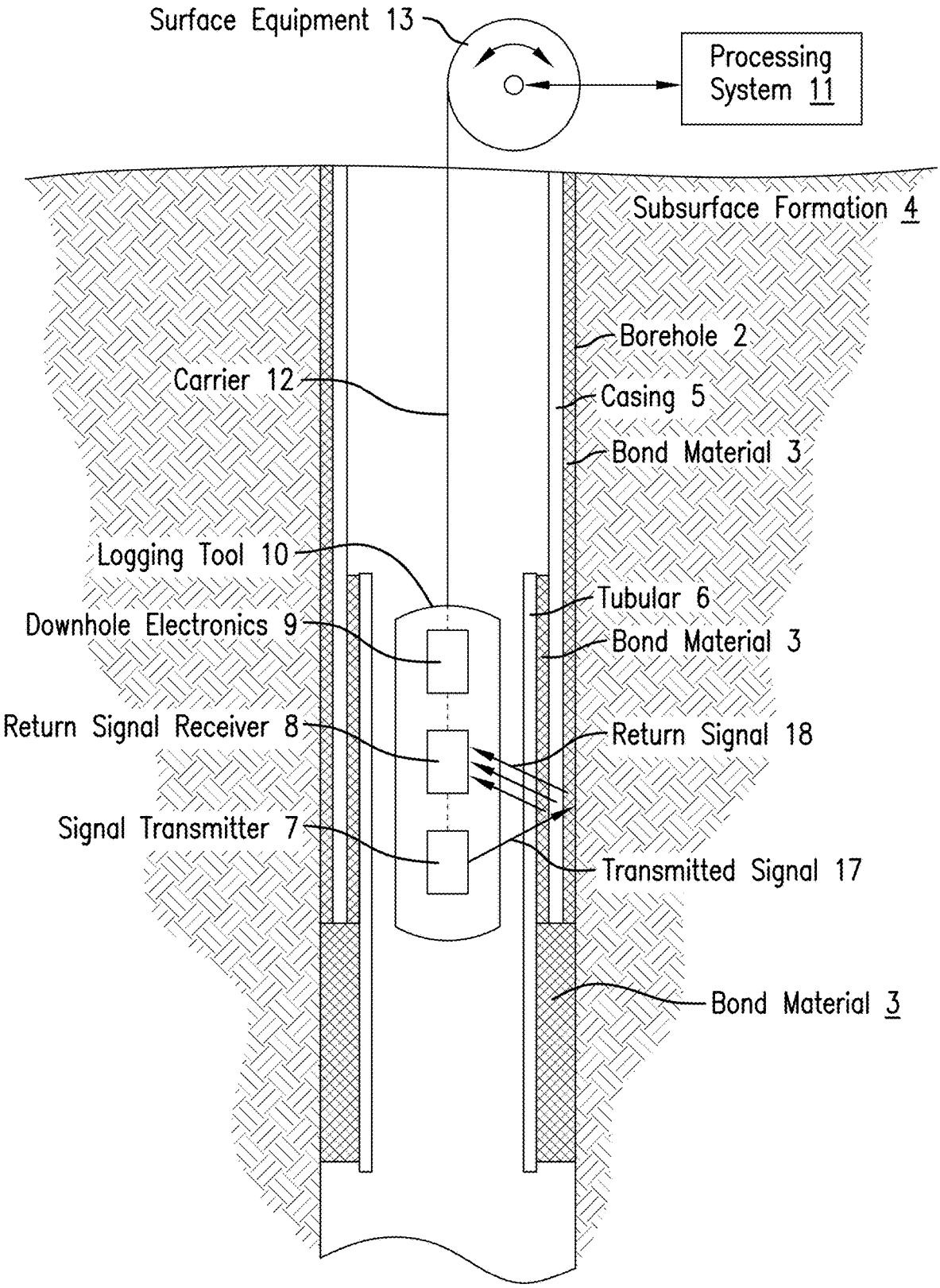
FIG. 1 is a cross-sectional view of an embodiment of a nested multiple tubular embodiment having a borehole lined with a casing bonded to the borehole.

FIG. 1 illustrates a cross-sectional view of a borehole 2 penetrating a subsurface formation 4. In hydrocarbon production embodiments, the formation 4 contains a reservoir of hydrocarbons. The borehole 2 is lined with a casing 5 that is bonded to the subsurface formation 4 by a bonding material 3 such as cement as a non-limiting example. The casing 5 may also be referred to as a tubular. A tubular 6 is disposed within the casing 5 and is bonded to the casing 5 also with the bonding material 3. Other tubulars may be disposed within each other (i.e., nested) within the tubular 6. The tubulars may be concentric or eccentric to an adjacent tubular to provide a nested multiple tubular environment.

A logging tool 10 is disposed within the tubular 6 or within an inner-most tubular. The logging tool 10 is supported and conveyed through the borehole 2 by a carrier 12. The carrier 12 is operated by surface equipment 13 such as a winch (as shown) or a drill rig. Non-limiting embodiments of the carrier 12 include a wireline (as shown) and a tubular such as a drill string. The logging tool 10 includes a signal transmitter 7 that is configured to transmit a signal 17 into and through tubulars and tubular bonds and into a wall of the formation 4. Accordingly, the transmitted signal 17 has sufficient energy to traverse the surrounding tubulars and corresponding tubular bonding material 3 and interact with the borehole wall. The transmitted signal interacts with (e.g., scattered and/or reflected by) each of the tubulars, tubular bonds, and borehole wall to provide a return signal 18, which can be multiple signals combined to form the return signal 18. The logging tool 10 includes a return signal receiver 8 that is configured to receive the return signal 18.

The signal transmitter 7 is configured to transmit one or more different types of signal energy. Non-limiting embodiments of the signal energy include acoustic energy such as acoustic waves of a certain amplitude and frequency, electromagnetic energy such as electromagnetic waves of a certain amplitude and frequency, and radiation such as neutrons or gamma-rays. The signal transmitter 7 may also be configured to transmit the energy at multiple energy levels or amplitudes and at multiple frequencies. Correspondingly, the return signal receiver 8 is configured to receive the one or more different types of transmitted signal energy. It is recognized that transmitted neutrons may interact with material to generate gamma-rays and, thus, the return signal receiver 8 may also be configured to receive gamma-rays when the transmitted signal 17 involves energetic neutrons. It can be appreciated that the return signal receiver 8 can be extended to a return signal receiver array or a cluster of receivers to acquire spatial dependent return signals.

In embodiments where the transmitted signal is acoustic waves, the signal transmitter 7 and the return signal receiver may include an electric acoustic transducer or an electromagnetic acoustic transducer (EMAT) in non-limiting embodiments. These types of acoustic transducers are configured to convert an electrical signal to an acoustic signal and, alternatively, convert an acoustic signal to an electrical signal. As such, a single acoustic transducer may be used to both transmit and receive acoustic signals.

In embodiments where the transmitted signal is electromagnetic waves, the signal transmitter 7 and the return signal receiver may include an antenna such as a coil in non-limiting embodiments. These types of acoustic transducers are configured to convert an electrical signal to an electromagnetic wave signal and, alternatively, convert an electromagnetic wave signal to an electrical signal. As such, a single antenna may be used to both transmit and receive electromagnetic wave signals.

In embodiments where the transmitted signal is radiation, the signal transmitter 7 may be an electronic pulsed-neutron generator in non-limiting embodiments. The electronic pulsed-neutron generator is configured to electronically convert electrical energy to a pulse of neutrons at a certain energy level. In this embodiment, the return signal receiver 8 can be configured to receive neutrons and/or gamma-rays due to their generation by neutron interactions within material.

The signal transmitter 7 and the return signal receiver 8 are coupled to downhole electronics 9. The downhole electronics 9 are configured to operate the signal transmitter 7, process signals received by the return signal receiver 8, and/or act as a telemetry interface to communicate signals with a surface processing system 11. Operating and processing functions relating to transmitting signals and receiving return signals may be performed by the downhole electronics 9, the surfaced processing system 11, and/or a combination thereof.

Figure 2:
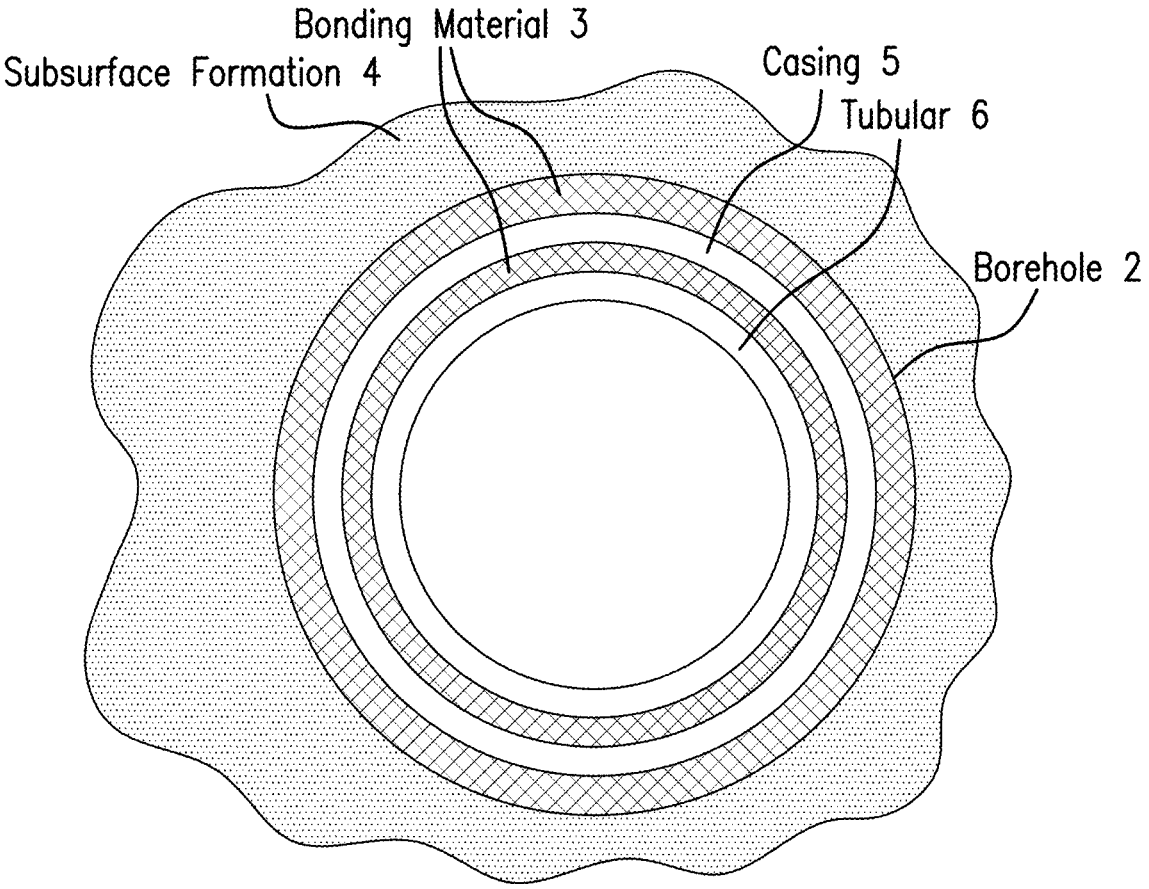
FIG. 2 is a top view of the nested multiple tubular embodiment.

FIG. 2 is a top view of the nested multiple tubular embodiment.

Figure 3:
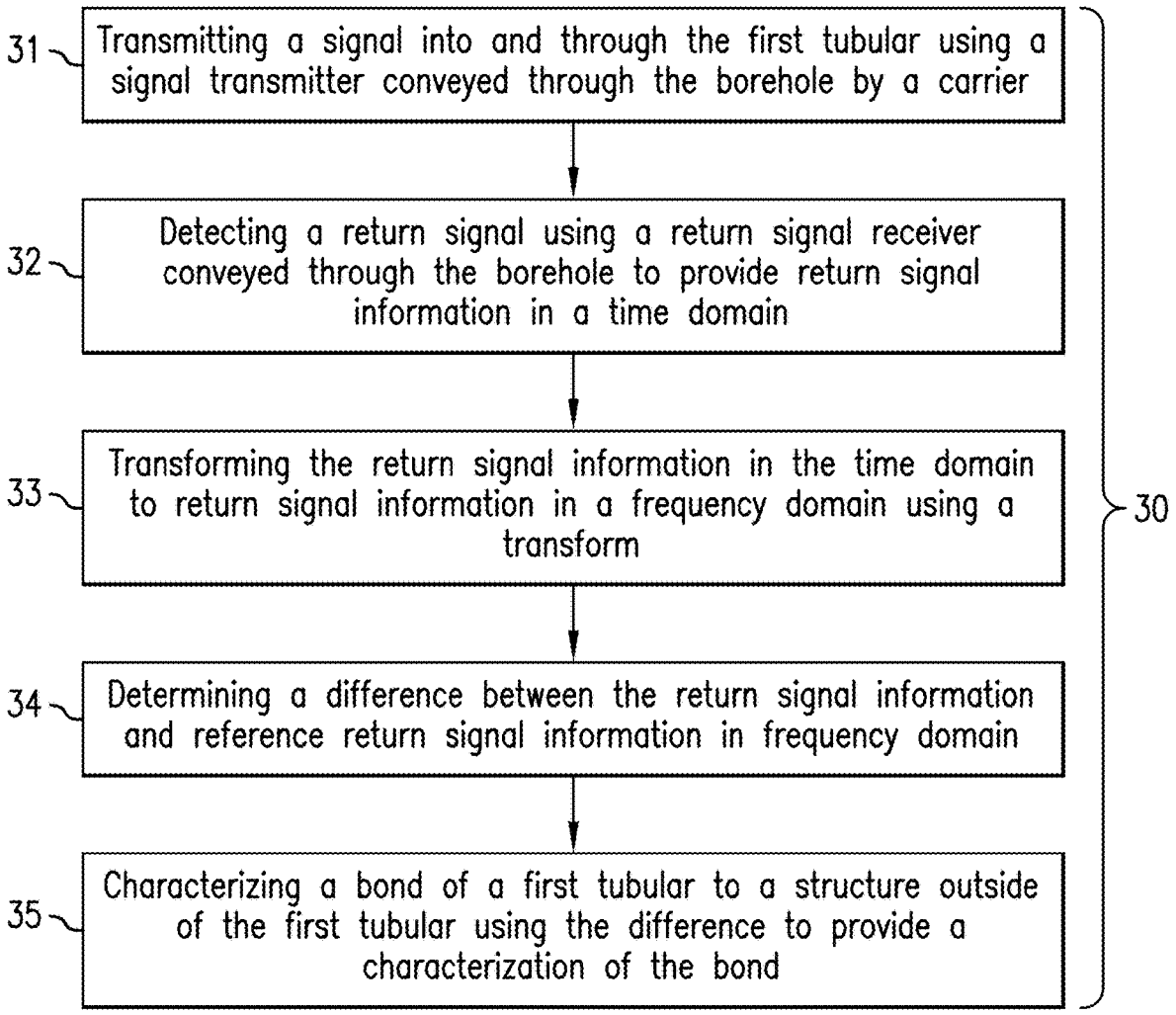
FIG. 3 is a flow chart for a method for characterizing a bond between a first tubular disposed in a borehole and a structure outside of the tubular.

FIG. 3 is a flow chart for a method 30 for characterizing a bond between a first tubular disposed in a borehole and a structure outside of the first tubular. Block 31 calls for transmitting a signal into and through the first tubular using a signal transmitter conveyed through the borehole by a carrier. The transmitted signal can be acoustic waves, electromagnetic waves, and/or radiation in one or more non-limiting embodiments. That is, the transmitted signal can be multiple types of signals. Multiple types of signals may be inclusive of signals having the same type of energy (e.g., acoustic or electromagnetic) but with different amplitudes and/or frequencies or frequency ranges. With multiple types of signals, one type of signal may have greater penetration than another type of signal, while the other type of signal may have greater resolution. Hence, combination or fusion of data derived from multiple types of signals may provide a more accurate characterization of the bond than the use of only one type of signal.

Figure 4:
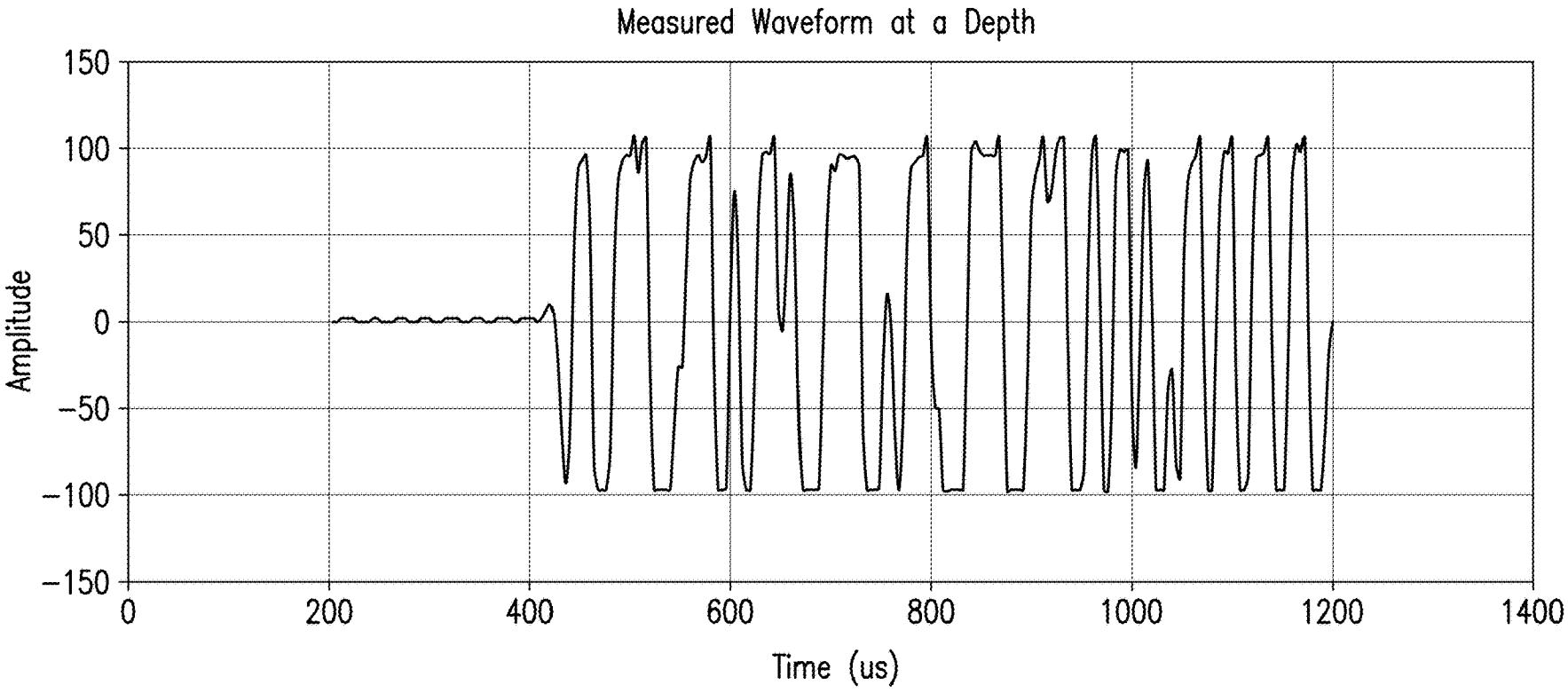
FIG. 4 depicts aspects of a return signal in a time domain for a certain depth.
Figure 5:
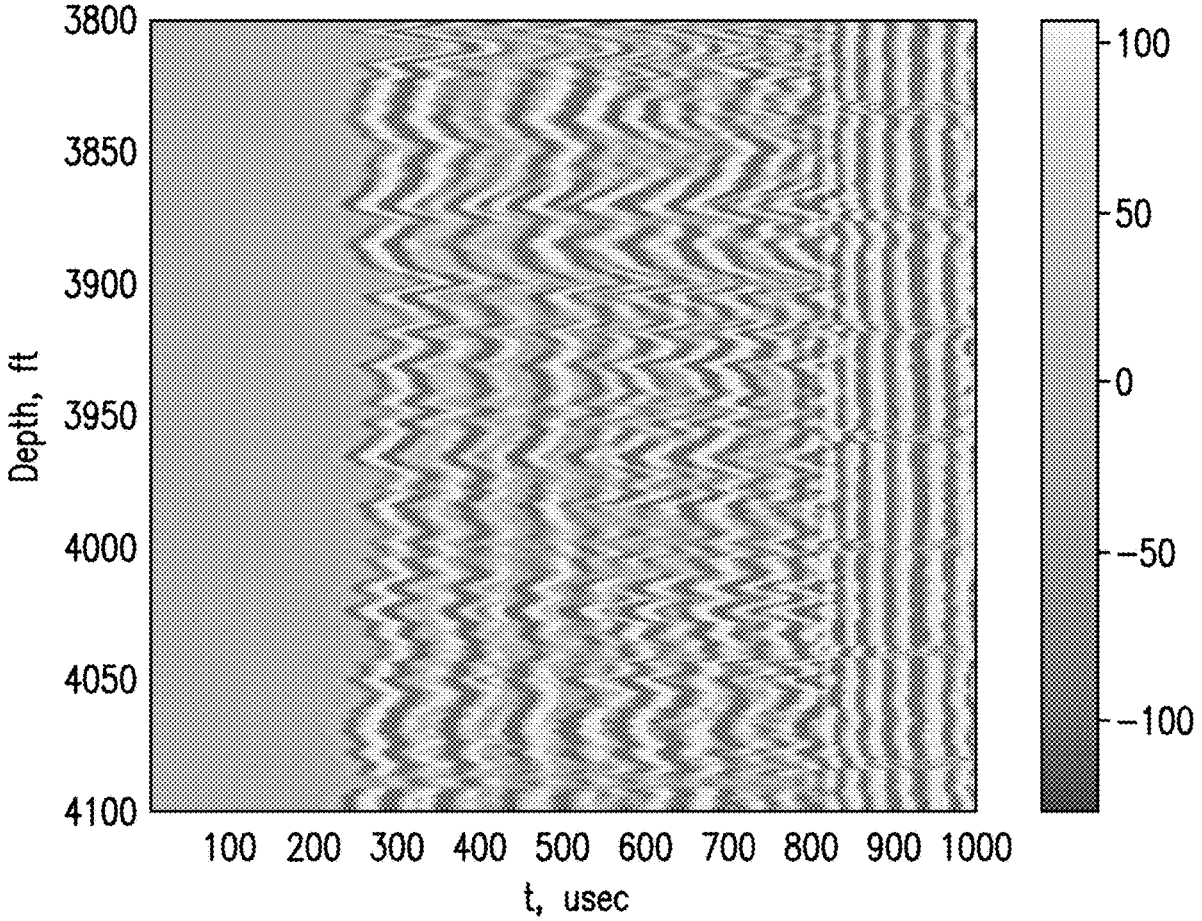
FIG. 5 depicts aspects of return signals in a time domain for a depth interval.

Block 32 calls for detecting a return signal using a return signal receiver conveyed through the borehole to provide return signal information in a time domain. The return signal is generated due to interactions and reflections of the transmitted signal with the tubular and tubular bonding material. For example, the return signal can be amplitude versus time. In one or more embodiments, the return signal as detected by the signal receiver is a time-varying voltage. For embodiments transmitting multiple types of signals, the return signal can include multiple types of signals in the time domain. FIG. 4 illustrates one example of a return signal in a time domain. FIG. 5 illustrates one example of return signals as a function of depth.

Figure 6:
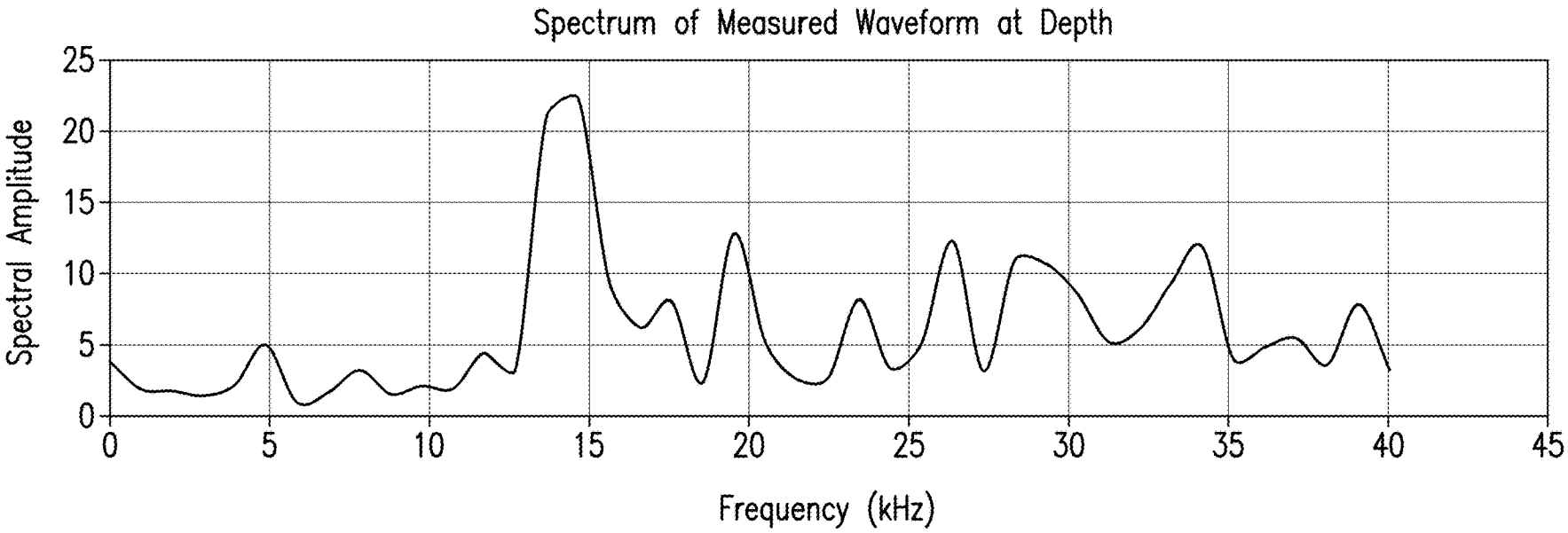
FIG. 6 depicts aspects of the return signal for the certain depth transformed into a frequency domain.
Figure 7:
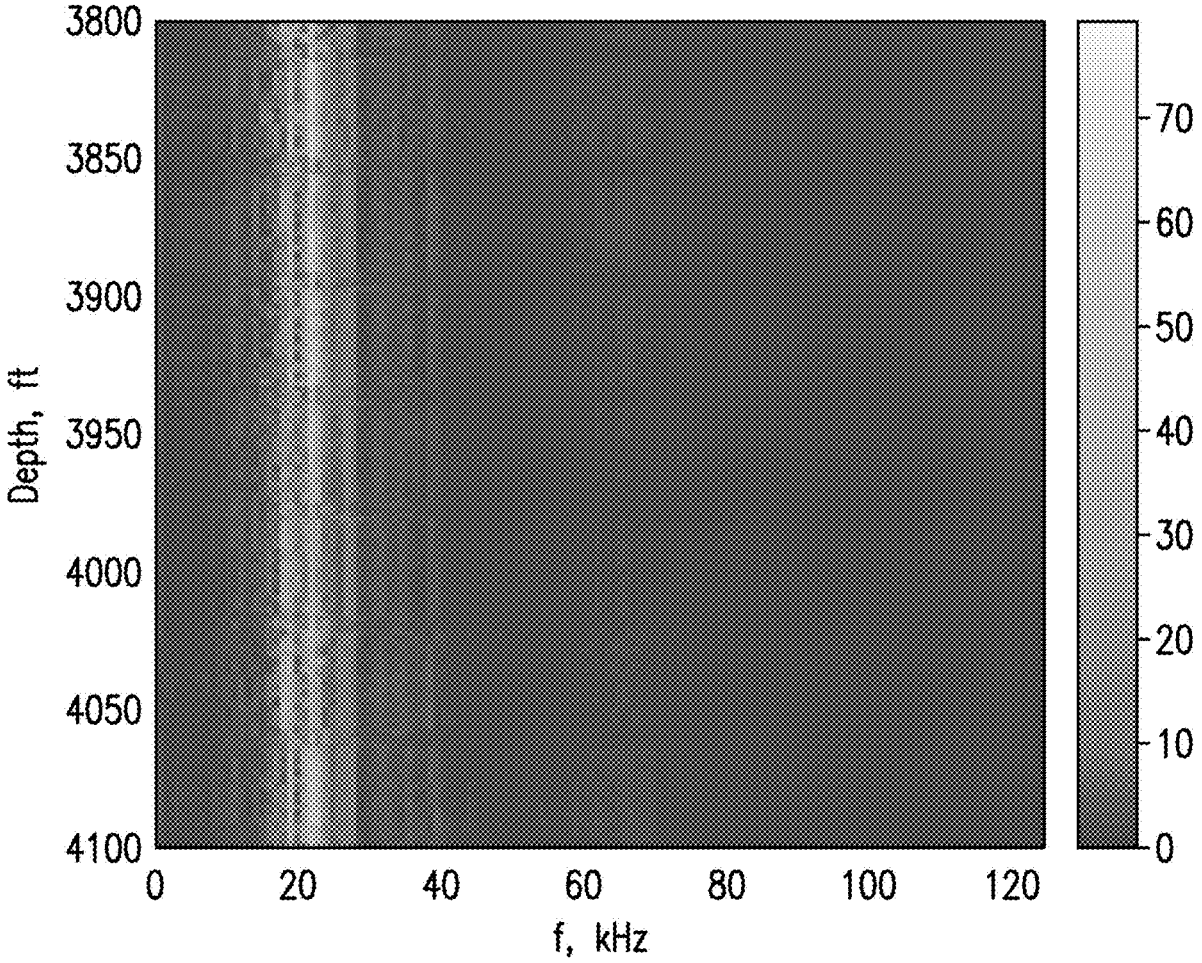
FIG. 7 depicts aspects of the return signals in the time domain transformed into a frequency domain.

Block 33 calls for transforming the return signal information in the time domain to return signal information in a frequency domain using a transform. Non-limiting embodiments of the transform include Fourier transform, Fast Fourier transform, Short-Time Fourier transform, sine wave transform, and cosine wave transform. Other frequency domain transforms may also be used. FIG. 6 illustrates one example of a Fourier transform of the time domain return signal in FIG. 4. FIG. 7 illustrates one example of a Fourier transform of the return signals in FIG. 5 as a function of depth.

Figure 8:
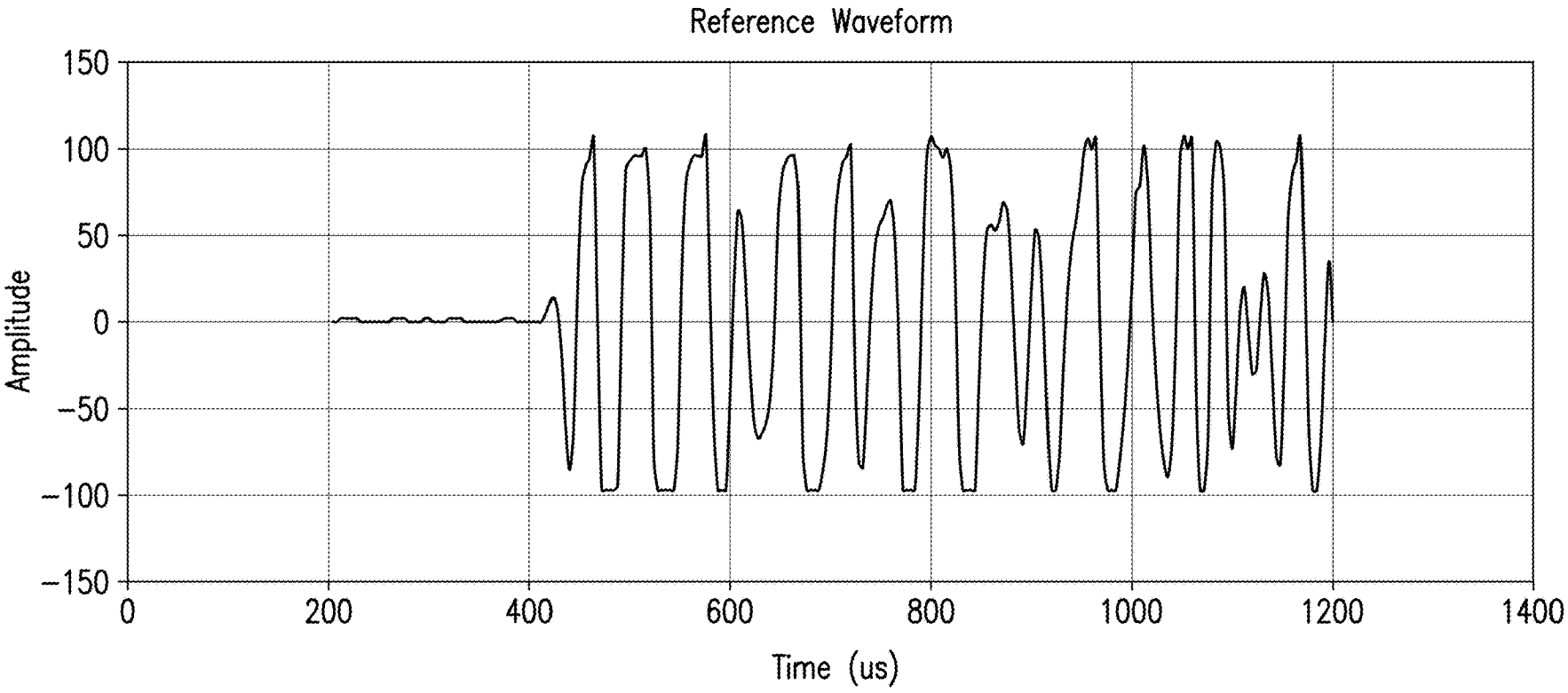
FIG. 8 depicts aspects of a reference return signal in a time domain for a certain configuration.
Figure 9:
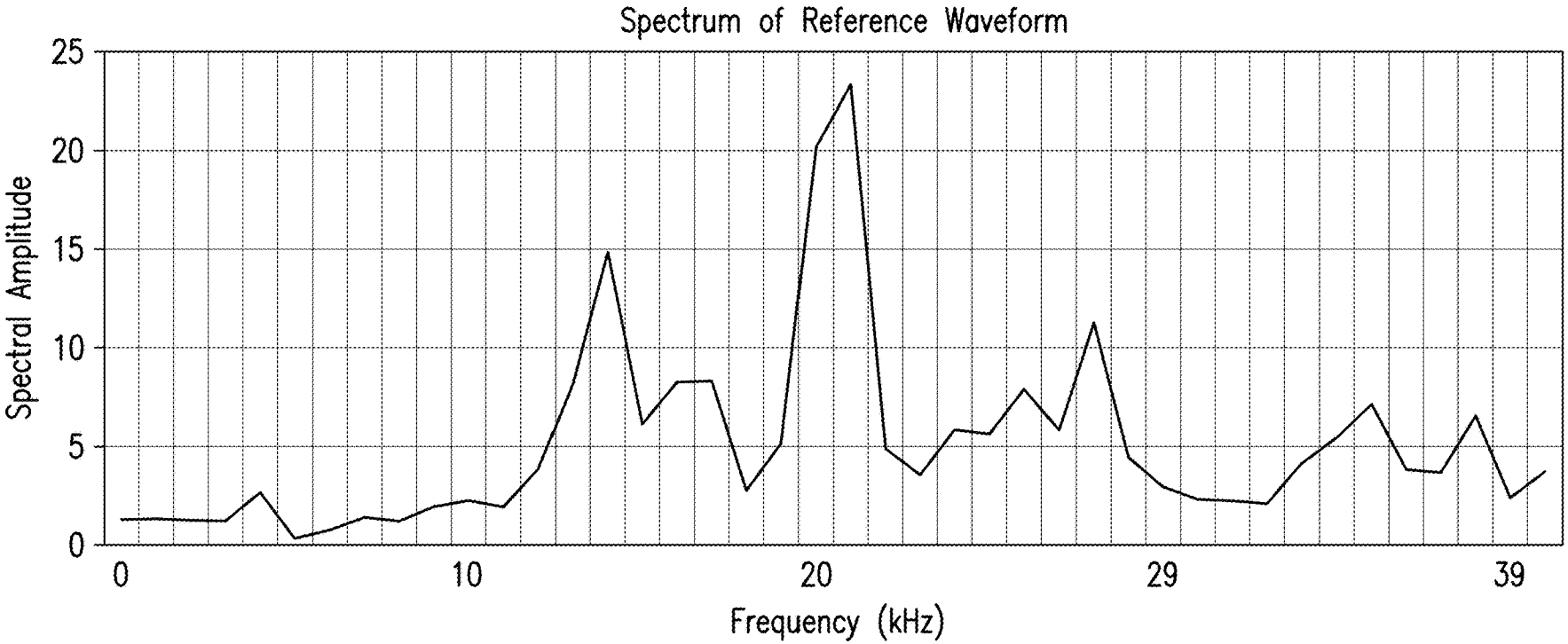
FIG. 9 depicts aspects of the reference return signal transformed into a frequency domain for comparison to an actual return signal in the frequency domain.

Block 34 calls for determining a difference between the return signal information in the frequency domain and reference frequency domain return signal information. Determining the difference may include quantifying that difference to provide a value of the difference. The reference frequency domain return signal information is based on a reference frequency domain return signal, which is a reference signal of a certain embodiment of a specific structure of interest or type of structure of interest. For example, the reference frequency domain return signal is a return signal in the frequency domain that would be generated when the structure or type of structure of interest would be subjected to a known transmitted signal. The reference frequency domain return signal can be obtained by experimentation by subjecting a reference structure or type of structure of interest to the known transmitted signal. The experimentation can be based on field studies or laboratory studies. Alternatively, the reference frequency domain return signal can be obtained by analysis such as for example performing a finite element analysis of the reference structure or type of structure of interest with each finite element being subjected to the known transmitted signal and calculating the response of the finite element. The reference structure can be of various embodiments of bonding. For example, the reference structure can be free from any type of bonding (i.e., free standing). In other embodiments, the reference structure can have complete bonding or various degrees of partial bonding. The reference frequency domain return signal information, however, it is obtained, is in the frequency domain so that it can be compared to the return signal information in the frequency domain in order to quantify a difference. FIG. 8 illustrates one example of a reference return signal in a time domain, while FIG. 9 illustrates that reference return signal in a frequency domain. The reference return signal for this example represents a free pipe or tubular condition, i.e. no cement in the annulus between the tubular and the formation.

The difference in block 24 may be determined and quantified in at least two methods as discussed below. Various other methods may also be used. In a first method, a parameter such as an amplitude spectrum (e.g., in a frequency range of 0 to approximately 40 KHz) in the frequency domain is compared to a corresponding reference amplitude spectrum of a reference embodiment such as a free pipe (fp) in the frequency domain by taking the ratio of those amplitude spectrums. This ratio may be referred to as a Quality Index (QI). In one embodiment, the QI is defined as an averaged ratio minus one as follows.

$$QI_m = \left[\frac{1}{N_{40}}\sum_{k=0}^{N_{40}-1} R_m(k)\right] - 1,\ m = m_s, m_s + 1, \ldots, m_e$$

$$N_{40} = \text{ceiling}\left(\frac{40}{f_s}N\right)$$

where:

m: sequential number of the m-th depth point in the vertical interval of data processing;

ms: sequential number of the first depth point in the vertical interval of data processing;

me: sequential number of the last depth point in the vertical interval of data processing;

$R_m(k)$:

$$R_m(k) = \frac{A_m(k)}{A_{fp}(k)}$$

is the frequency amplitude spectrum ratio for the k-th frequency;

$A_m$: frequency amplitude spectrum at m-th depth point;

$A_{fp}$: frequency amplitude spectrum at free pipe condition;

N: length of frequency spectrum;

N40: sequential number of frequency point at which the selected frequency is 40 kHz; ceiling: is math operator for rounding a number up to the nearest integer; and $f_s$: sampling frequency of signal.

Figure 10:
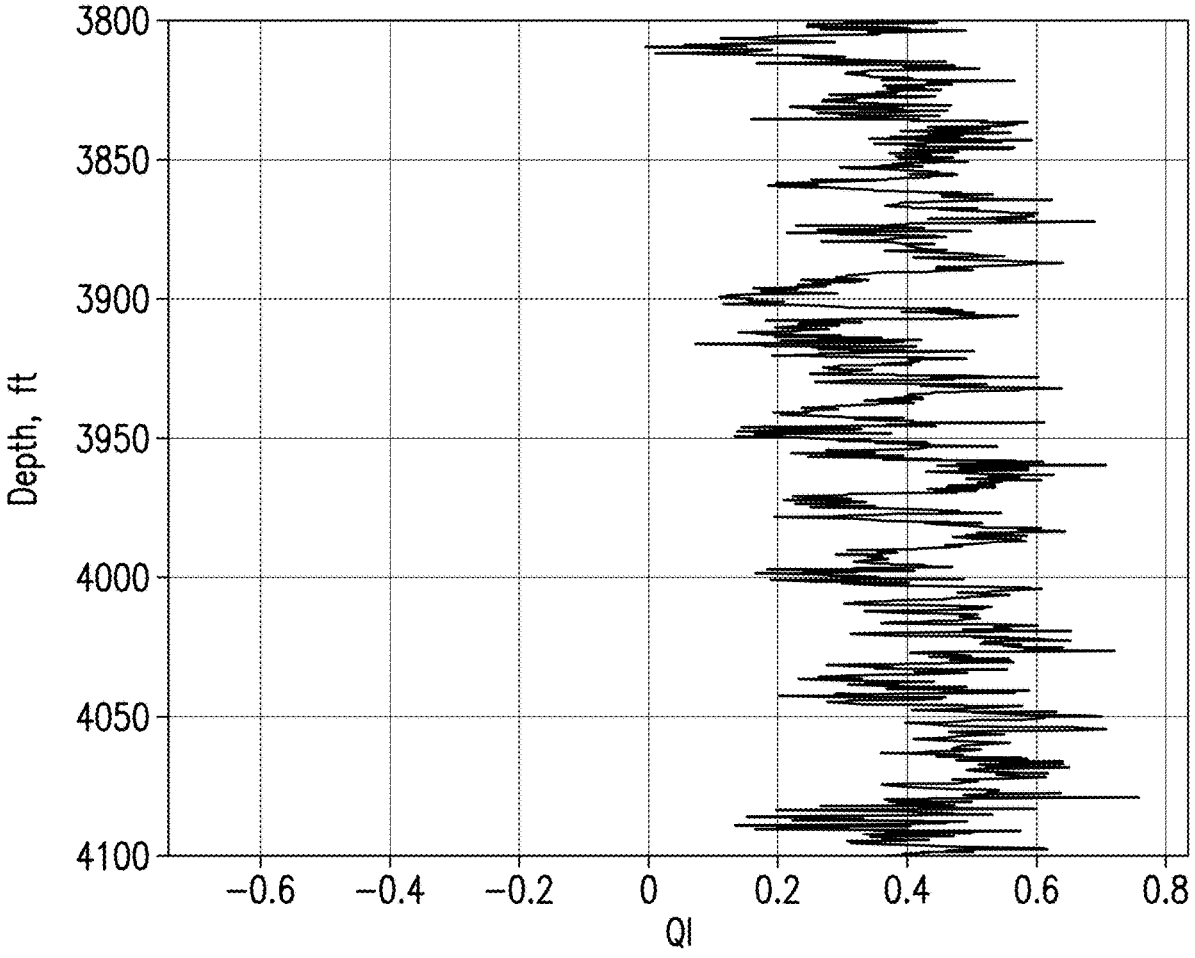
FIG. 10 depicts aspects of a Quality Index (QI) quantifying a difference between a frequency domain return signal and a frequency domain reference signal.

For bonding characterization, the QI quantifies how close the actual bond is to the reference structural bond. A threshold value may be defined to identify any defects in the bond. For example, with the reference frequency domain return signal representing a complete satisfactory bond, a threshold value may be established such that the difference is within a selected percentage value (5% for example) to indicate that the actual bond is satisfactory. Conversely, if the QI is outside of the selected percentage value, then the actual bond is characterized as being unsatisfactory. Alternatively, a sliding scale may also be used to quantify different levels of unsatisfactory (or satisfactory) based on the calculated QI value. It can be appreciated that other types of reference structures may also be used for bonding characterization such as a free-standing pipe (i.e., no bonding) for example. FIG. 10 illustrates one example of a curve of QI as a function of depth using the [average ratio−1] defined above. In general, the value of QI varies in range [−0.3, 0.7]. The high QI indicates good cement bonding, while low QI indicates poor cement bonding. For the free pipe condition, QI is less than zero. QI vs. depth curve can be interpreted in one or more embodiments as: >0.6 means fully bonded; [0.4, 0.6] means partially bonded; [0.2, 0.4] means poorly bonded; [0, 0.2] means loss of most bonding; and <=0 means free standing pipe with no bonding.

Figure 11:
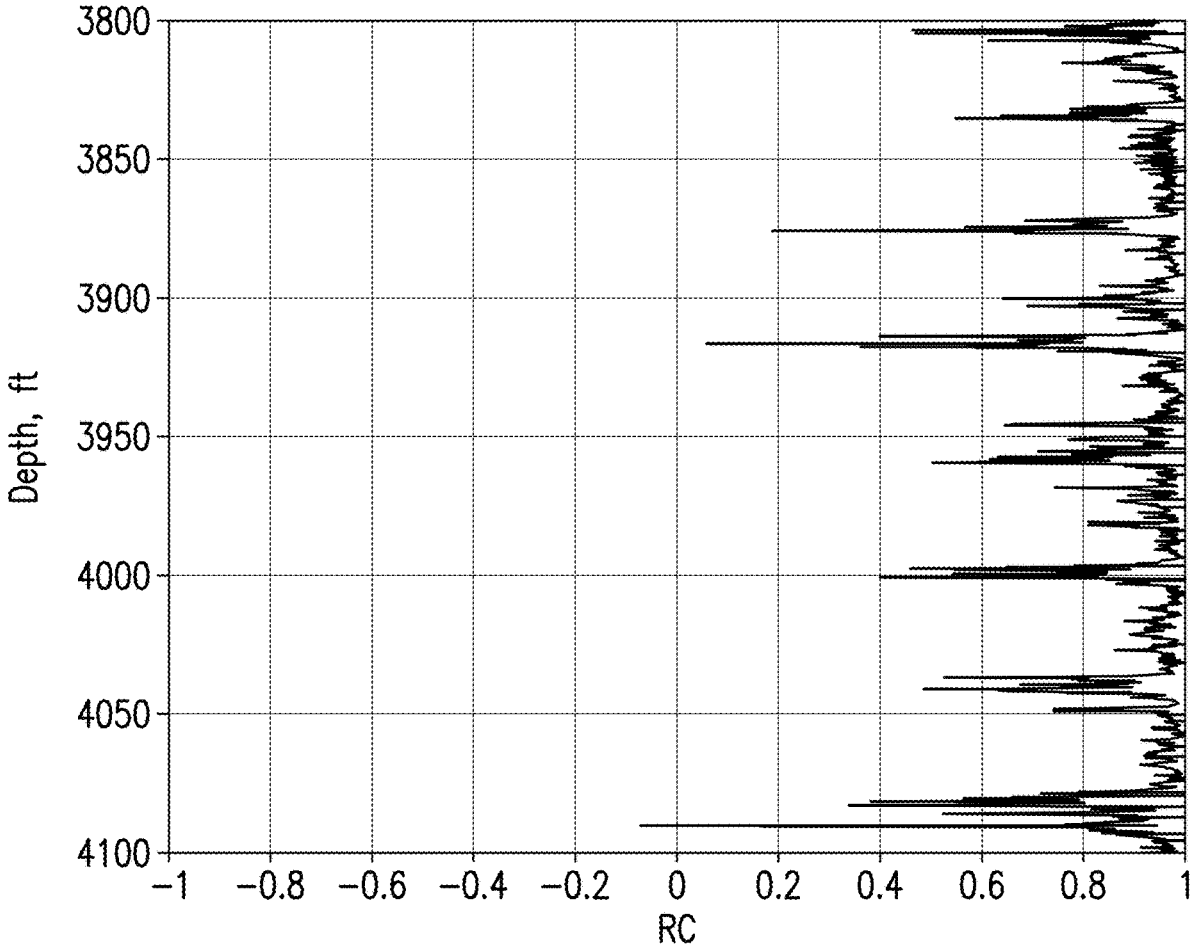
FIG. 11 depicts aspects of a cross-correlation coefficient (RC) quantifying a difference between a frequency domain return signal and a frequency domain reference signal.

In a second method, a cross-correlation algorithm is applied to the return signal information in the frequency domain and the reference frequency domain return signal information to provide a cross-correlation coefficient indicative of how close the return signal information in the frequency domain is to the reference frequency domain return signal information. In one example, the reference information is for a free-standing tubular with no bonding. Hence, a cross-correlation coefficient indicating a high degree of correlation will characterize the actual tubular as being free standing with no bonds or bonding. Various cross-correlation algorithms may be used. As with the first method, a threshold value for the cross-correlation coefficient may be used to determine whether a bond is satisfactory or not. Similar to the first method, a sliding scale also be used to quantify different levels of unsatisfactory (or satisfactory). FIG. 11 illustrates one example of a cross-correlation coefficient (RC) as a function of depth. RC is an indicator for local structure variances, such as a casing collar, corrosion flaws on pipes, and variances of lithology of formation. If only RC is used for interpretation, RC can be used for identifying and locating casing collars, i.e. the spikes on the curve RC vs. depth. If RC<0.4 for example, it indicates that there is a casing collar at the corresponding depth. For identification of corrosions of pipes and variances of formation lithology, RC and other logs, such as gamma ray log, may be jointly used.

Block 35 calls for characterizing the bond of the first tubular to the structure outside of the first tubular using the difference to provide a characterization of the bond. The term "characterizing" relates to identifying a quality of the bond such as identifying if the bond is satisfactory, is completely bonded, has minor imperfections (e.g., small cracks), is unsatisfactory, has major imperfections (e.g., large cracks), is absent, or is partially absent. In one or more embodiments, QI and RC can be used together to verify the findings of one using the other or to differentiate casing collars from good cement bonding.

Block 35 may also include performing a physical task or operation based on the characterization of the bond. For example, if the bond is characterized as being satisfactory, then the physical task or operation may include abandoning the well according to appropriate regulations such as by enclosing an opening to the well. In another example, if the bond is characterized as being unsatisfactory, then the physical action or operation may include remediation tasks such as removing and replacing the section of the tubular having the unsatisfactory bond with a new tubular and bond. These physical actions or operations may be referred to in general as physical borehole-related actions or operations. The borehole-related actions or operations may be performed by equipment configured to perform these actions or operations.

One embodiment of algorithms and/or mathematical equations for implementing the method 30 are now discussed. In particular, an algorithm for computing a quality index of cement bounding and computing a cross-correlation coefficient using acoustic logging data includes the following stages.

Stage 1: Obtain and load well environmental parameters, including well name, well location, total vertical depth (TVD), measured depth (MD), borehole inner diameters (IDs), formation thicknesses, formation densities, formation porosities, formation saturations, formation matrix compositions, mud types, mud densities, borehole fluids, completion intervals, casing outer diameters (ODs), casing thickness, casing lengths, casing weights, tubing OD, tubing thickness, and tubing weight. "Load" refers to loading data into a computer model of the tubular or tubulars disposed in a wellbore.

Stage 2: Load acoustic logging data.

Stage 3: Identify casing string intervals, which have unique casing parameters and load this data.

Stage 4: Determine the sequential number range of depth sampling points $[m_0, M]$ of the acoustic logging data.

Stage 5: In the determined depth sampling point range, perform FFT on the waveforms of acoustic log data.

$$X_m(k) = \sum_{n=0}^{N-1} x_m(n) W_N^{kn},\ k = 0, 1, \ldots, N-1 \tag{1}$$

$$x_m(n) = x_m(nT_s),\ m = m_0, m_0+1, \ldots, M$$

$$W_N^{kn} = e^{-j\frac{2\pi}{N}kn}$$

$$f_s = 1/T_s,\ f_K = \frac{k}{N} f_s$$

where $\{x_m f(n), n=0, 1, \ldots, N-1\}$, $m=m_0, m_0+1, \ldots, M$ is the waveform signal at the m-th depth sampling point, $\{X_m(k), k=0, 1, \ldots, N-1\}$, $m=m_0, m_0+1, \ldots, M$ denotes the FFT of the waveform signal at the m-th depth sampling point. $T_s$ is the sampling time interval of waveforms. $f_s$ is sampling frequency of waveforms, in units of kHz.

Stage 6: Compute the amplitude spectra of waveforms acquired at the selected depth range.

$$A_m(k) = |X_m(k)|, k=0,1, \ldots, N, m=m_0, m_0+1, \ldots, M \tag{2}$$

Stage 7: Compute the correlation coefficient between waveforms at neighboring depths.

$$\rho_m = \frac{\sum_{n=0}^{N-1} [x_m(n) x_{m+1}(n)]}{\sqrt{\sum_{n=0}^{N-1} [x_m(n)]^2} \sqrt{\sum_{n=0}^{N-1} [x_{m+1}(n)]^2}},\quad m = m_0, m_0+1, \ldots, M-1 \tag{3}$$

Stage 8: Search the amplitude spectrum of the free pipe condition, which has the maximum amplitude at frequency of 20 kHz and extremely high correlation coefficient.

$$A_{fp}(k) = \max\left\{A_m\left(\frac{20}{f_s}N\right)\right\},\ \rho_m > 0.99999,\ k = 0, 1, \ldots, N \tag{4}$$

Stage 9: Select the depth sampling point range $[m_s, m_e]$ for evaluating cement bounding quality.

Stage 10: Compute the ratio between the amplitude spectrum of waveform and the amplitude spectrum of the free pipe condition in the selected depth sampling point range $[m_s, m_e]$.

$$R_m(k) = \frac{A_m(k)}{A_{fp}(k)},\ k = 0, 1, \ldots, N-1,\quad m = m_s, m_s+1, \ldots, m_e \tag{5}$$

Stage 11: Compute the quality indices of cement bounding in the selected depth sampling point range $[m_s, m_e]$.

$$QI_m = \left[\frac{1}{N_{40}} \sum_{k=0}^{N_{40}-1} R_m(k)\right] - 1,\ m = m_s, m_s+1, \ldots, m_e \tag{6}$$

$$N_{40} = \text{ceiling}\left(\frac{40}{f_s}N\right)$$

The disclosure herein provides several advantages. One advantage is that the quality of cement or other bonding material can be characterized without having to physically cut into or penetrate a tubular bonded by that material, i.e. non-destructive cement evaluation. Another advantage is that different signals having different types of energy can be used to characterize the quality of the bonding material. Yet another advantage is that the data obtained using the different types of signals can be combined or fused to provide a more accurate and precise characterization than would be possible with only one type of signal. Yet another advantage is that a point in a bond located in three-dimensional space can be characterized using data obtained from a single signal receiver or transducer.

Embodiment 1: A method for characterizing a bond between a first tubular disposed in a borehole and a structure outside of the first tubular, the method including: transmitting a signal into and through the first tubular using a signal transmitter conveyed through the borehole, detecting a return signal using a return signal receiver conveyed through the borehole to provide return signal information in a time domain, transforming the return signal information in the time domain to return signal information in a frequency domain using a transform, determining a difference between the return signal information in the frequency domain and reference frequency domain return signal information, and characterizing the bond of the first tubular to the structure outside of the first tubular using the difference to provide a characterization of the bond.

Embodiment 2: The method according to any prior embodiment, wherein the structure includes a borehole wall.

Embodiment 3: The method according to any prior embodiment, wherein the structure includes a second tubular.

Embodiment 4: The method according to any prior embodiment, wherein the first tubular is bonded to the second tubular and the second tubular is bonded to a borehole wall.

Embodiment 5: The method according to any prior embodiment, wherein the bond includes cement.

Embodiment 6: The method according to any prior embodiment, wherein the transmitted signal includes acoustic waves.

Embodiment 7: The method according to any prior embodiment, wherein the transmitted signal includes electromagnetic waves.

Embodiment 8: The method according to any prior embodiment, wherein the transmitted signal includes radiation.

Embodiment 9: The method according to any prior embodiment, wherein the radiation includes a neutron pulse.

Embodiment 10: The method according to any prior embodiment, wherein the return signal includes at least one of gamma radiation and neutron radiation.

Embodiment 11: The method according to any prior embodiment, wherein the transform includes at least one of a Fourier transform, a Fast Fourier transform, a Short-Time Fourier transform, a sine wave transform, or a cosine wave transform.

Embodiment 12: The method according to any prior embodiment, wherein the difference includes a difference between an amplitude spectrum of the return signal information in the frequency domain and a reference amplitude spectrum in the reference frequency domain return signal information.

Embodiment 13: The method according to any prior embodiment, further comprising: calculating a quality index for the bond comprising a ratio of an amplitude spectrum of the return signal information in the frequency domain to a reference amplitude spectrum in the reference frequency domain return signal information; and detecting a defect in the bond in response to the quality index by comparing the ratio to a threshold value.

Embodiment 14: The method according to any prior embodiment, wherein transmitting a signal includes transmitting a plurality of signals using a plurality of signal transmitters.

Embodiment 15: The method according to any prior embodiment, wherein detecting a return signal includes detecting a plurality of return signals using a plurality of return signal receivers.

Embodiment 16: The method according to any prior embodiment, wherein characterizing the bond includes identifying a defect in the bond and a location of the defect.

Embodiment 17: The method according to any prior embodiment, further comprising performing a borehole-related action in response to the characterization of the bond.

Embodiment 18: An apparatus for characterizing a bond of a first tubular disposed in a borehole to a structure outside of the first tubular, the apparatus including a carrier configured to be conveyed through the borehole, a signal transmitter disposed on the carrier and configured to transmit a signal into and through the first tubular, a return signal detector disposed on the carrier and configured to detect a return signal to provide return signal information in a time domain, and a processor configured to: (i) transform the return signal in the time domain to return signal information in a frequency domain using a transform; (ii) determine a difference between the return signal information in the frequency domain and reference frequency domain return signal information; and (iii) characterize the bond of the first tubular to the structure outside of the first tubular using the difference.

Embodiment 19: The apparatus according to any prior embodiment, wherein characterization of the bond includes detecting a defect in the bond and a location of the defect and the apparatus further includes a user interface configured to present the detected defect in the bond and the location of the detected defect.

In support of the teachings herein, various analysis components may be used, including a digital and/or an analog system. For example, the signal transmitter 7, the return signal receiver 8, the downhole electronics 9, and/or the surface processing system 11 may include digital and/or analog systems. The system may have components such as a processor, storage media, memory, input, output, communications link (wired, wireless, optical or other), user interfaces (e.g., a display or printer), software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a power supply, magnet, electromagnet, sensor, electrode, transmitter, receiver, transceiver, antenna, controller, optical unit or components, electrical unit or electromechanical unit may be included in support of the various aspects discussed herein or in support of other functions beyond this disclosure.

Elements of the embodiments have been introduced with either the articles "a" or "an." The articles are intended to mean that there are one or more of the elements. The terms "including" and "having" and the like are intended to be inclusive such that there may be additional elements other than the elements listed. The conjunction "or" when used with a list of at least two terms is intended to mean any term or combination of terms. The term "configured" relates one or more structural limitations of a device that are required for the device to perform the function or operation for which the device is configured. The terms "first" and "second" are used to distinguish between different elements and do not denote a particular order.

The flow diagram depicted herein is just an example. There may be many variations to this diagram or the steps (or operations) described therein without departing from the scope of the invention. For example, operations may be performed in another order or other operations may be performed at certain points without changing the specific disclosed sequence of operations with respect to each other. All of these variations are considered a part of the claimed invention.

The disclosure illustratively disclosed herein may be practiced in the absence of any element which is not specifically disclosed herein.

While one or more embodiments have been shown and described, modifications and substitutions may be made thereto without departing from the scope of the invention. Accordingly, it is to be understood that the present invention has been described by way of illustrations and not limitation.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed:

1. A method for characterizing a bond between a first tubular disposed in a borehole and a structure outside of the first tubular, the method comprising:

transmitting a signal into and through the first tubular using a signal transmitter conveyed through the borehole;

detecting a return signal using a return signal receiver conveyed through the borehole to provide return signal information in a time domain;

transforming the return signal information in the time domain to return signal information in a frequency domain using a transform;

determining at least one of (i) a Quality Index (QI) value based upon an average of a ratio of an amplitude spectrum of the return signal information in the frequency domain for a first selected frequency range to a reference amplitude spectrum for a reference structure for the first selected frequency range or (ii) a cross-correlation coefficient that quantifies a difference between the amplitude spectrum of the return signal information for a selected second frequency range and the reference amplitude spectrum for the reference structure for the selected second frequency range; and characterizing the bond of the first tubular to the structure outside of the first tubular using the at least one of the QI value or the cross-correlation coefficient.

2. The method according to claim 1, wherein the structure comprises a borehole wall.

3. The method according to claim 1, wherein the structure comprises a second tubular.

4. The method according to claim 3, wherein the first tubular is bonded to the second tubular using a first bond and the second tubular is bonded to a borehole wall.

5. The method according to claim 1, wherein the bond comprises cement.

6. The method according to claim 1, wherein the transmitted signal comprises acoustic waves.

7. The method according to claim 1, wherein the transmitted signal comprises electromagnetic waves.

8. The method according to claim 1, wherein the transmitted signal comprises radiation.

9. The method according to claim 8, wherein the radiation comprises a neutron pulse.

10. The method according to claim 8, wherein the return signal comprises at least one of gamma radiation and neutron radiation.

11. The method according to claim 1, wherein the transform comprises at least one of a Fourier transform, a Fast Fourier transform, a Short-Time Fourier transform, a sine wave transform, or a cosine wave transform.

12. The method according to claim 1, further comprising performing a borehole-related action in response to the characterization of the bond.

13. The method according to claim 1, further comprising detecting a defect in the bond by comparing the QI value to a threshold value.

14. The method according to claim 1, wherein transmitting a signal comprises transmitting a plurality of signals using a plurality of signal transmitters.

15. The method according to claim 14, wherein detecting a return signal comprises detecting a plurality of return signals using a plurality of return signal receivers.

16. The method according to claim 1, wherein characterizing the bond comprises identifying a defect in the bond and a location of the defect.

17. The method according to claim 1, wherein the Quality Index value represented as $QI_m$ is determined as follows:

$$QI_m = \left[\frac{1}{N_Z}\sum_{k=0}^{N_Z-1} R_m(k)\right] - 1,\ m = m_s, m_s+1, \ldots, m_e$$

$$N_Z = \text{ceiling}\left(\frac{Z}{f_s}N\right)$$

where:

m: sequential number of the m-th depth point in the vertical interval of data processing;

$m_s$: sequential number of the first depth point in the vertical interval of data processing;

$m_e$: sequential number of the last depth point in the vertical interval of data processing;

$R_m(k)$: $R_m(k)=A_m(k)/A_{ref}(k)$ is the frequency amplitude spectrum ratio for the k-th frequency;

$A_m$: frequency amplitude spectrum at m-th depth point;

$A_{ref}$ frequency amplitude spectrum for reference structure condition;

N: length of frequency spectrum;

$N_Z$: sequential number of frequency point at highest frequency Z of a frequency range;

ceiling: is math operator for rounding a number up to the nearest integer; and $f_s$: sampling frequency of signal.

18. The method according to claim 17, wherein Z=40 kHz, the first frequency range is 0 to 40 kHz, and the reference structure condition is that of a free pipe.

19. An apparatus for characterizing a bond of a first tubular disposed in a borehole to a structure outside of the first tubular, the apparatus comprising:

a carrier configured to be conveyed through the borehole;

a signal transmitter disposed on the carrier and configured to transmit a signal into and through the first tubular;

a return signal detector disposed on the carrier and configured to detect a return signal to provide return signal information in a time domain; and a processor configured to: (i) transform the return signal information in the time domain to return signal information in a frequency domain using a transform; (ii) determine at least one of (iii) a Quality Index (QI) value based upon an average of a ratio of an amplitude spectrum of the return signal information in the frequency domain for a selected first frequency range to a reference amplitude spectrum for a reference structure for the selected first frequency range or (iv) a cross-correlation coefficient that quantifies a difference between the amplitude spectrum of the return signal information for a selected second frequency range and the reference amplitude spectrum for the reference structure for the selected second frequency range; and (v) characterize the bond of the first tubular to the structure outside of the first tubular using the at least one of the QI value or the cross-correlation coefficient.

20. The apparatus according to claim 19, wherein characterization of the bond comprises detecting a defect in the bond and a location of the defect and the apparatus further comprises a user interface configured to present the detected defect in the bond and the location of the detected defect.

21. The apparatus according to claim 19, wherein the processor is further configured to determine the Quality Index value represented as $QI_m$ as follows:

$$QI_m = \left[\frac{1}{N_Z}\sum_{k=0}^{N_Z-1} R_m(k)\right] - 1,\ m = m_z, m_s + 1, \ldots, m_e$$

$$N_Z = \text{ceiling}\left(\frac{Z}{f_z}N\right)$$

where:

m: sequential number of the m-th depth point in the vertical interval of data processing;

$m_s$: sequential number of the first depth point in the vertical interval of data processing;

$m_e$: sequential number of the last depth point in the vertical interval of data processing;

$R_m(k)$: $R_m(k)=A_m(k)/A_{ref}(k)$ is the frequency amplitude spectrum ratio for the k-th frequency;

$A_m$: frequency amplitude spectrum at m-th depth point;

$A_{ref}$ frequency amplitude spectrum for reference structure condition;

N: length of frequency spectrum;

$N_Z$: sequential number of frequency point at highest frequency Z of a frequency range;

ceiling: is math operator for rounding a number up to the nearest integer; and $f_s$: sampling frequency of signal.

* * * * *